US007774971B2

(12) United States Patent
Laney et al.

(10) Patent No.: US 7,774,971 B2
(45) Date of Patent: Aug. 17, 2010

(54) MUZZLE LOADING FIREARM WITH REMOVABLE BREECH CAP

(75) Inventors: Mark C. Laney, Lee, NH (US); Gregory James Ritz, Stratham, NH (US)

(73) Assignee: Thompson Center Arms Company, Inc., Rochester, NH (US)

( * ) Notice: Subject to any disclaimer, the term of this patent is extended or adjusted under 35 U.S.C. 154(b) by 700 days.

(21) Appl. No.: 11/649,458

(22) Filed: Jan. 3, 2007

(65) Prior Publication Data

US 2010/0154270 A1 Jun. 24, 2010

(51) Int. Cl.
*F41C 7/00* (2006.01)

(52) U.S. Cl. ..... 42/51; 89/1.3

(58) Field of Classification Search ..... 42/51; 89/1.3

See application file for complete search history.

(56) References Cited

U.S. PATENT DOCUMENTS

| | | | | | |
|---|---|---|---|---|---|
| 3,656,250 | A * | 4/1972 | Brown | 42/76.01 |
| 3,728,938 | A * | 4/1973 | Scibor et al. | 89/26 |
| 4,123,866 | A * | 11/1978 | Wiethoff | 42/77 |
| 4,854,065 | A | 8/1989 | French et al. | |
| 5,487,232 | A * | 1/1996 | Osborne et al. | 42/51 |
| 5,615,507 | A | 4/1997 | French | |
| 5,639,981 | A | 6/1997 | French | |
| 5,680,722 | A | 10/1997 | French et al. | |
| 5,782,030 | A | 7/1998 | French | |
| 5,907,920 | A | 6/1999 | Laney | |
| 5,941,004 | A * | 8/1999 | Pedersoli | 42/51 |
| 6,145,235 | A | 11/2000 | Emerson et al. | |
| 6,219,951 | B1 | 4/2001 | Cate | |
| 6,532,692 | B2 | 3/2003 | Cate | |
| 6,604,311 | B1 | 8/2003 | Laney et al. | |
| 6,834,455 | B2 | 12/2004 | Burigana | |
| 7,140,138 | B1 | 11/2006 | Laney et al. | |
| 7,257,917 | B1 | 8/2007 | Garland | |
| 7,526,888 | B1 * | 5/2009 | Joyce | 42/51 |
| 2004/0134112 | A1 * | 7/2004 | Lizarralde et al. | 42/51 |
| 2006/0026881 | A1 * | 2/2006 | Watley | 42/51 |
| 2006/0248771 | A1 | 11/2006 | Richards | |
| 2007/0137084 | A1 | 6/2007 | Laney et al. | |
| 2007/0163162 | A1 | 7/2007 | Laney et al. | |

* cited by examiner

*Primary Examiner*—J. Woodrow Eldred
*Assistant Examiner*—Gabriel J Klein
(74) *Attorney, Agent, or Firm*—McCormick, Paulding & Huber LLP

(57) ABSTRACT

A muzzle loading firearm has an elongated barrel defining an elongated bore, with a muzzle end and a breech end. A breech cap is removably connected the breech end of the barrel to enclose a chamber at the rear of the bore. A portion of the breech cap may be external to the barrel, which may be externally threaded. The breech cap may be entirely clear of the breech bore, and the bore may have a consistent profile from end to end. The barrel threads may be standard, multi-start or interrupted. The breech cap may overlay the face of the rear end of the barrel.

7 Claims, 4 Drawing Sheets

MUZZLE LOADING FIREARM WITH REMOVABLE BREECH CAP

FIELD OF THE INVENTION

This invention relates to muzzle loading firearms, and more particularly to removable breech closures.

BACKGROUND AND SUMMARY OF THE INVENTION

Muzzle loading rifles have an essentially closed breech at the rear of the barrel, so that powder and bullets must be loaded at the muzzle or forward end of the barrel. A typical muzzle loading rifle has a barrel with a breech plug attached to occupy an enlarged internally threaded rear bore portion of the barrel at the breech end. In some rifles, the breech plug is permanently attached. In others, the breech plug is removable to facilitate pass-through cleaning of the bore.

A typical removable breech plug employs a finely threaded elongated body that screws into the rear of the barrel, with 10-15 turns to secure it in place. The barrel's rear end is internally threaded to receive the plug, which removes for cleaning (not for normal loading operations.) The cleaning process involves the passing of a rod with a brush at the end through the entire length of the barrel. The brush, wetted with a liquid cleaning agent, dissolves and dislodges fouling, and it is dragged out of an end of the barrel. The fouled brush may pass over the internal threads at the breech, allowing the threads to become fouled. This is a concern because the barrel threads are cut to a tight tolerance for a close fit with the plug threads, and minor fouling can make the plug difficult to reinstall or remove after reinstallation.

In addition, breech plugs are generally larger in diameter than the bore of the barrel. This means that the wall thickness surrounding the plug is thinner than it is just forward of the plug in the chamber. In at least some instances, this wall diameter at the plug may be a strength limitation, requiring a larger barrel diameter than otherwise would be required, increasing manufacturing cost and/or weight.

The barrel must be designed to provide an adequate safety margin to retain the breech plug even in overpressure circumstances in the chamber. The barrel must have adequate thickness to resist excessive expansion in such extreme circumstances, to ensure that the barrel's internal threads do not fail to retain the plug.

Further, the length of a breech plug must be greater than an adequate threshold to provide strength to retain the pressure in the chamber. This length extends the length of the barrel without extending the length from the breech face to the muzzle. The added barrel length increases the weight and cost without the performance advantages of a lengthened barrel.

The elongated breech plug is a solid steel mass with only a small central bore to provide a fire passage between a primer and the chamber. The plug itself has appreciable mass to fill the required length and diameter, with weight reducing measures being generally impractical, even though lightness is generally desired in many rifles.

The present invention overcomes the limitations of the prior art by providing a muzzle loading firearm having an elongated barrel defining an elongated bore, with a muzzle end and a breech end. A breech cap is removably connected the breech end of the barrel to enclose a chamber at the rear of the bore. A portion of the breech cap may be external to the barrel, which may be externally threaded. The breech cap may be entirely clear of the breech bore, and the bore may have a consistent profile from end to end. The barrel threads may be standard, multistart or interrupted. The breech cap may overlay the face of the rear end of the barrel.

DETAILED DESCRIPTION OF A PREFERRED EMBODIMENT

Figure 1:
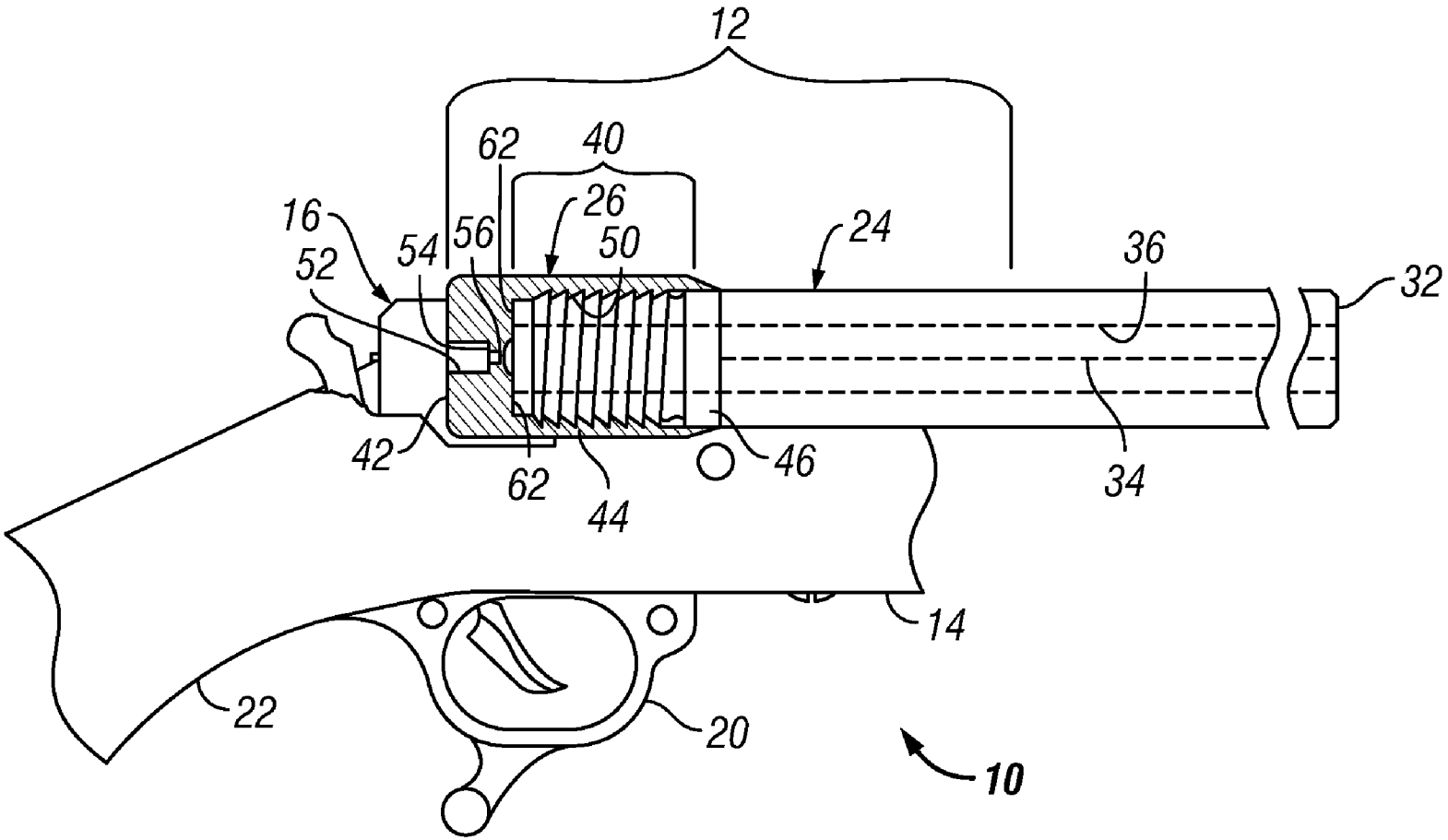
FIG. 1 is a sectional side view of a firearm according to a preferred embodiment of the invention.

FIG. 1 shows a muzzleloading firearm 10 having a barrel assembly 12 with a connected forestock 14. A breech block 16, trigger assembly 20, and rear stock 22 are pivotally linked to the barrel.

The barrel assembly 12 includes a barrel 24 and a breech cap 26. The barrel has a muzzle end face 30 and a breach end face 32, each perpendicular to an axis 34 defined by the conventionally rifled bore 36. The bore extends for the entire length of the barrel, having a consistent profile from end to end. That is, it has a consistent diameter throughout the entire length defining a continuous cylinder, except for the variations inherent in conventional helical rifling. The grooves and lands of the rifling extend from end to end in the barrel, and each of the groove diameter and the land diameter remain constant throughout the length of the barrel.

A rear portion 40 of the length of the barrel nearest the breach end 32 is externally threaded to accommodate the removable breach 26. In the illustrated embodiment, the threaded portion extends between one and two times the barrel overall diameter. The threads are shown as buttress threads, to provide maximum strength in resisting rearward forces on the breech cap 26 due to expansion of propellant gases in the chamber to find at the rear end of the barrel's bore. Alternative thread arrangements are discussed below.

The barrel has a conventional exterior profile, in that it is cylindrical at the rear portion forward of the threaded portion. In various embodiments, external profile of the barrel may extend as a cylinder forward to the muzzle, or it may taper toward the muzzle. The largest diameter portion of the barrel is just forward of the threaded portion. The threaded portion has a maximum diameter less than or equal to the barrel maximum diameter. This allows the threads to be economically manufactured from a barrel blank of an appropriate limited diameter size. In the preferred embodiment, the barrel's maximum external diameter is 1.0 inch, the threaded portion has a length of 1.25 inch, with 10 buttress-type threads. The bore has a diameter of 0.500 inch, and the barrel has a length ranging between 24 and 30 inches.

The breech cap 26 is a generally cylindrical body having the shape of a cup, with a circular base 42 having a forwardly extending sleeve or rim 44. The base and rim define a forwardly-open cylindrical chamber 46 that is internally threaded with threads 50 that mate with the threaded portion 40 of the barrel. The base 42 defines a central axial cylindrical primer pocket 52 having a floor 54 that defines a central fire hole 56, which communicates with the cylindrical chamber 46. The forward surface 60 of the base provides a flat angular surface against which the rear face 32 of the barrel abuts. These surfaces are tightly abutted to provide a gas seal against escape of propellant gases from the chamber upon discharge. In alternative embodiments, the surface may be shaped differently, such as with a conical or dished contour, as long as a close fit and seal are formed.

In the preferred embodiment, the breech cap 26 has a length of 2.0 inches, and a diameter of 1.2 inch. The base 42 has a thickness of 0.50 inch, and the length of the fire hole is 0.125 inch. The diameter of the cap is slightly larger than the outside diameter of the barrel, although an alternative embodiments, the diameters may be made equal by cutting the threads to a smaller diameter relative to the barrel outside diameter.

Figure 2A:
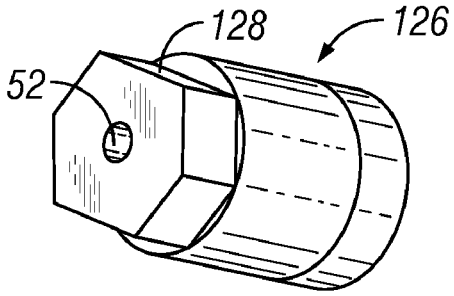
FIGS. 2A-C are perspective views of alternative breech cap exterior configurations.
Figure 2B:
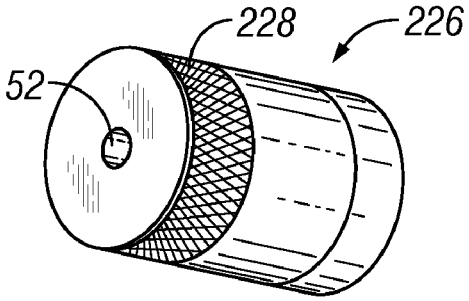
Figure 2C:
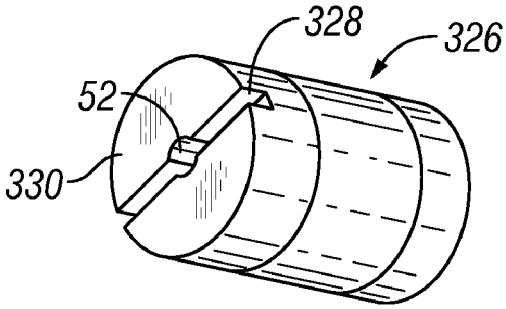

FIG. 2A shows an alternative breech cap 126 having a hexagonal shape 128 at the rear portion to provide a tool-engaging feature. This feature facilitates the element being installed on and removed from the barrel. FIG. 2B shows a further alternative 226 having a knurled portion 228 to allow gripping for installation and removal. FIG. 2C shows an alternative breech cap 326 defining a slot 328 across the rear surface 330 to provide engagement by a screwdriver or other flat tool.

Figure 3A:
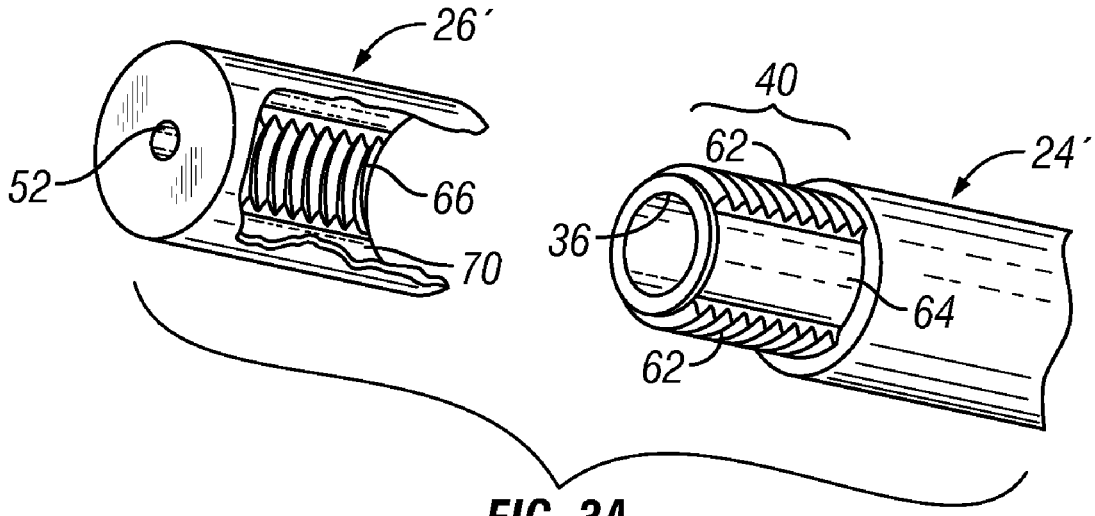
FIGS. 3A and 3B are perspective views alternative thread configurations.
Figure 3B:
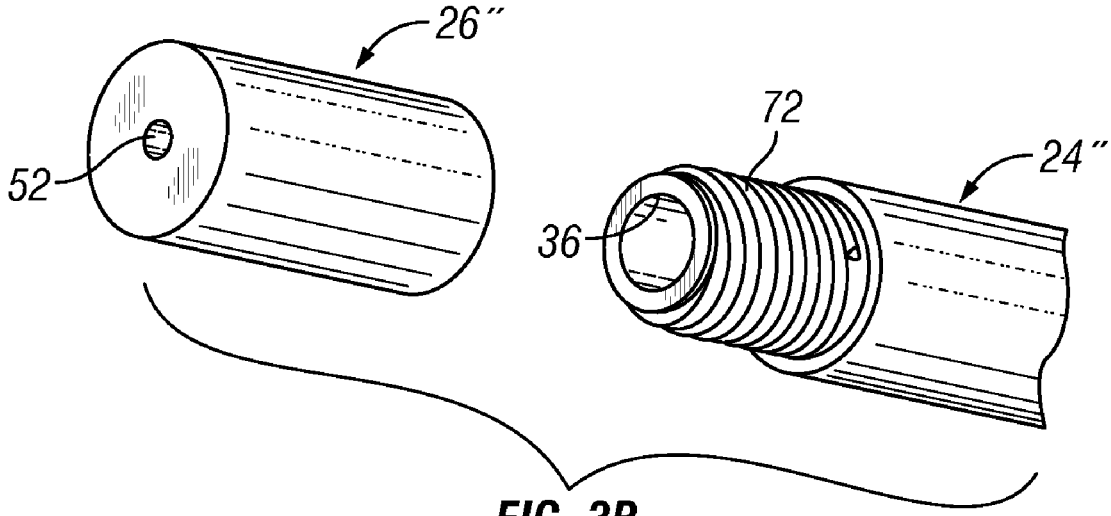
Figure 4:
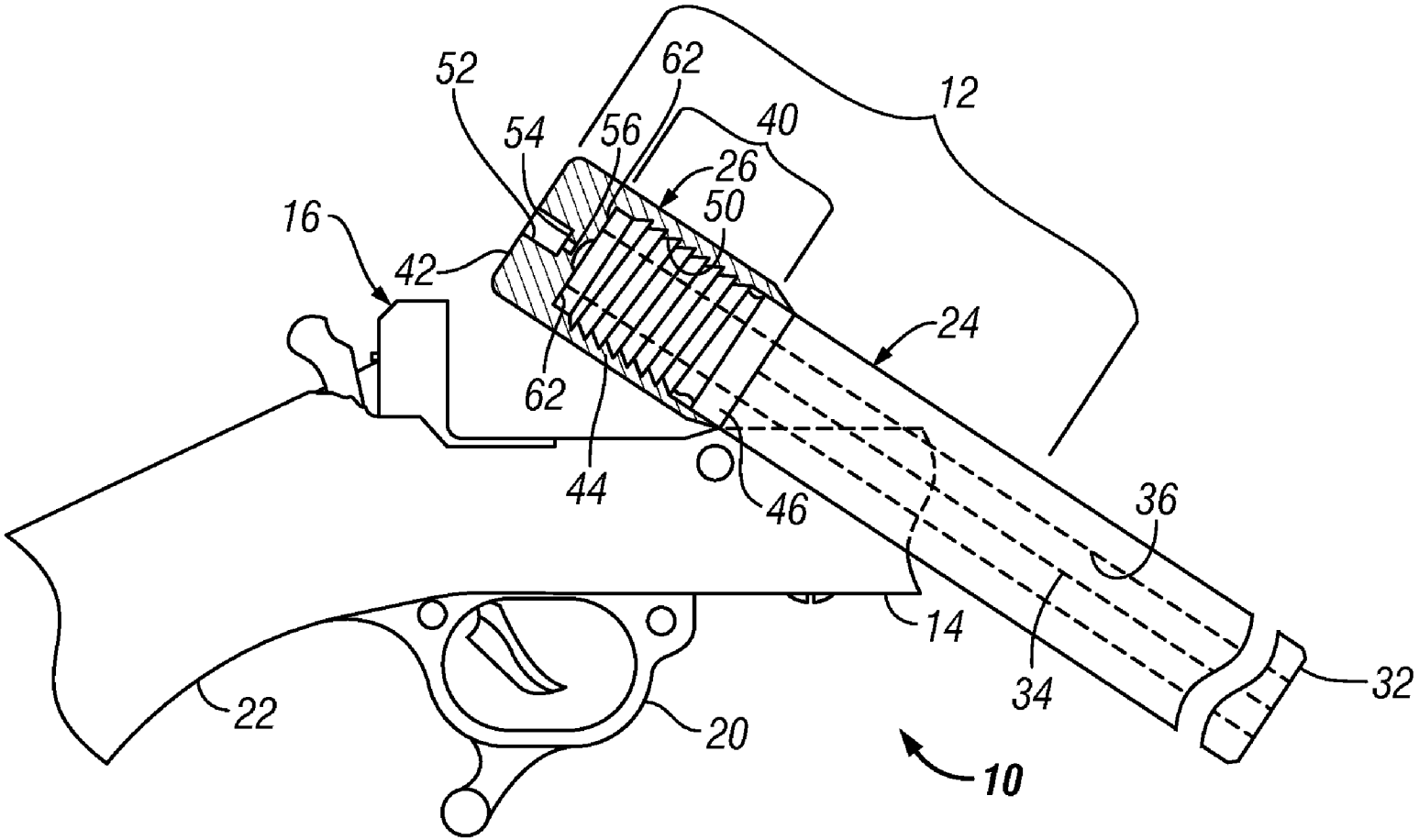
FIG. 4 is a sectional side view of the firearm shown in FIG. 1, with barrel pivoted upward from breech block, according to a preferred embodiment of the invention.

FIGS. 3A and 3B show alternative thread configurations. In FIG. 3A, the barrel 24' and cap 26' are provided with interrupted threads, so that the threaded portion 40 of the barrel has two spaced apart threaded portions 62 separated by smooth cylindrical clearance portions 64. The cap has corresponding threaded portions 66 and smooth cylindrical portions 70. Thus, the cap may be actually installed on the bore by aligning the threaded portions of one piece with the smooth portions of the other piece and then rotating the cap approximately one quarter turn to provide thread engagement and to secure the cap.

In FIG. 3B, the barrel 24" and cap 26" are provided with multi-start threads 72, so that a single rotation of the cap advances it axially by several thread pitch increments (four, in the illustrated embodiment.) This provides fewer rotations to install and remove the cap.

As shown in FIG. 1, the breech block 16 serves to capture a primer in the primer pocket, and retain it during firing, while the breech cap serves to retain the gas pressure in the chamber. The side wall of the breach cap further supports the rear portion of the barrel against expansion, providing additional strength. Nonetheless, the sidewall need only have limited thickness to provide sufficient axial tensile strength, thus providing a relatively lightweight design. In addition, the base 42 of the breech cap need have only a limited thickness sufficient to provide a proper seating depth for the primer, and to provide adequate gas pressure retention.

The disclosed configurations provide a relatively short overall rifle length and overall barrel length for a given length of usable bore. Because the breech cap does not extend into the bore, it allows the entire length of the bore to be used by the propellant and projectile, unlike conventional designs in which a breech plug is inserted to a significant depth within the bore, adding weight and reducing usable bore length.

While the above is discussed in terms of preferred and alternative embodiments, the invention is not intended to be so limited.

The invention claimed is:

1. A muzzle loading firearm comprising:

a barrel having a bore extending from a muzzle end to a breech end, an end surface at the breech end, and an externally-threaded surface at the breech end;

a stock pivotally connected to said barrel between the breech end and the muzzle end; and a breech cap having a base portion with a front face and an opposed rear face, a primer pocket formed in the rear face of the base portion, a flash hole extending from the primer pocket through the base portion to the front face, and an annular skirt encircling the base portion with an internally-threaded portion of the skirt extending forward from the front face, wherein said breech cap is removably threadedly connected to the externally-threaded surface of said barrel to enclose the breech end of the bore with the front face of the base portion of said breech cap sealingly abutting on the end surface at the breech end of said barrel.

2. The firearm of claim 1 wherein the bore of said barrel has a substantially constant inner diameter from the breech end to the muzzle end.

3. The firearm of claim 1 wherein said breech cap has a tool engaging feature formed within the outer diameter of the skirt and at a rearward portion of said breech cap.

4. The muzzle-loading firearm according to claim 1, wherein the externally threaded surface at the breech end of said barrel includes at least one of multi-start threads and interrupted threads.

5. The firearm of claim 4 wherein the threads are multi-start threads.

6. The firearm of claim 4 wherein the threads are interrupted threads.

7. The firearm of claim 4 wherein the bore has a substantially constant inner diameter from the breech end to the muzzle end.

* * * * *